United States Patent [19]

Davis et al.

[11] Patent Number: 4,793,196

[45] Date of Patent: Dec. 27, 1988

[54] GEAR COUPLED, COUNTER-ROTATING VIBRATORY DRIVE ASSEMBLY

[75] Inventors: Walter L. Davis, Milton-Freewater, Oreg.; Joseph C. Thomas, Aberdeen, S. Dak.

[73] Assignee: Key Technology, Inc., Milton-Freewater, Oreg.

[21] Appl. No.: 30,051

[22] Filed: Mar. 24, 1987

[51] Int. Cl.[4] ..... B06B 1/16

[52] U.S. Cl. ..... 74/61; 74/DIG. 10

[58] Field of Search ..... 74/61, DIG. 10

[56] References Cited

U.S. PATENT DOCUMENTS

| | | | |
|---|---|---|---|
| 1,517,587 | 12/1924 | Roth . | |
| 1,827,586 | 10/1931 | Keefer . | |
| 1,999,213 | 12/1935 | Shaler . | |
| 2,144,382 | 1/1939 | Lincoln et al. | 74/61 |
| 2,766,629 | 10/1956 | Booth | 74/61 |
| 2,897,734 | 8/1959 | Bodine | 74/61 |
| 3,053,379 | 9/1962 | Roder et al. . | |
| 3,417,966 | 12/1968 | Bodine | 74/61 |
| 3,473,396 | 10/1969 | Schwake . | |
| 3,583,246 | 6/1971 | Stahle et al. . | |
| 3,625,074 | 12/1971 | Waschulewski et al. . | |
| 3,630,357 | 12/1971 | Nolte | 74/61 |
| 3,772,302 | 3/1973 | Piatkowski et al. . | |
| 3,776,352 | 12/1973 | Musschoot . | |
| 4,050,527 | 9/1977 | Lebelle | 74/61 |
| 4,196,637 | 4/1980 | Barrot et al. . | |
| 4,212,731 | 7/1980 | Wallin et al. . | |
| 4,255,254 | 3/1981 | Faust et al. . | |
| 4,341,126 | 7/1982 | Thomas . | |
| 4,651,575 | 3/1987 | Morishita et al. | 74/DIG. 10 |
| 4,712,451 | 12/1987 | Morishita et al. | 74/DIG. 10 |

FOREIGN PATENT DOCUMENTS

| | | | |
|---|---|---|---|
| 2021685 | 11/1971 | Fed. Rep. of Germany | 74/DIG. 10 |
| 7708864 | 8/1977 | Netherlands | 74/DIG. 10 |

OTHER PUBLICATIONS

Frank W. Wood, "More Quick-Disconnect Linkages", *Mechanisms Linkages & Mechanical Controls*, McGraw-Hill Book Company, New York, 1965, pp. 352-353.

*Primary Examiner*—Lawrence Staab

*Attorney, Agent, or Firm*—Wells, St. John & Roberts

[57] ABSTRACT

A gear coupled, counter-rotating vibratory assembly is described for producing a fine tuned accurate linear vibratory motion without any twisting force component. The assembly has two parallel shafts that extend through a gear casing with cantilevered ends extending outward from both sides of casing. Large intermeshing gears are mounted on the shafts to rotate the shafts in counter-rotating synchronized motion. One of the gears has metal teeth and the other gear has plastic teeth. Identical eccentric weights are mounted on the cantilevered shaft ends outside of the gear casing at the same angular positions to generate the linear vibratory motion. The eccentric weights on the drive shaft are offset inward of the weights on the driven shaft. The radius of each of the eccentric weights is greater than the radius of the gear but less than the diameter of the gears.

9 Claims, 4 Drawing Sheets

GEAR COUPLED, COUNTER-ROTATING VIBRATORY DRIVE ASSEMBLY

TECHNICAL FIELD

This invention relates to gear coupled, counter-rotating vibratory drive assemblies for generating linear vibratory motion.

BACKGROUND OF THE INVENTION

For many years, gear coupled, counter-rotating vibratory drive assemblies have been provided as vibratory drive assemblies for generating linear vibratory motion to convey and separate particulate material, and for other applications in which linear vibratory motion is beneficial.

Although various types of counter-rotating vibratory drive assemblies have been suggested, the standard counter-rotating vibratory drive assembly uses a gear-coupled arrangement to provide synchronous motion of two unbalanced drive shafts that are driven by a single motor. The present day commercial units are an outgrowth of the design illustrated in U.S. Pat. No. 1,999,213 granted to Shaler on Apr. 30, 1935. Somewhat similar designs are illustrated in the early U.S. Pat. Nos. 1,517,587 granted to Roth and 1,827,586 granted to Keefer.

Although such gear coupled, counter-rotating vibratory drive assemblies have been commercially popular, they have not been without significant maintenance and reliability problems. Such problems have been highlighted in more recent patents such as U.S. Pat. Nos. 3,473,396 (Schwake et al.); 4,212,731 (Wallin et al.); and 4,255,254 (Faust et al.).

The Schwake et al. U.S. Pat. No. 3,473,396 mentions the severe shocks that are encountered by the gears upon startup and shutdown. The Schwake et al. design is intended to eliminate such severe shocks by the use of frictional wheels rather than gears.

Others have suggested that instead of using a single motor for driving both shafts through a gear coupling, that it is advisable to utilize two separate motors through separate drives that can be synchronized. Examples of such techniques are illustrated in the Wallin, et al., U.S. Pat. No. 4,212,731. It, too, criticizes the gear coupled arrangement as requiring unnecessary mass and increased maintenance costs. Furthermore, it mentions that experience has shown that gearing is undesirable since tremendous forces are developed in the gears. The Faust, el al. U.S. Pat. No. 4,255,254 emphasizes that the gear coupled, counter-rotating systems require unnecessary bulk of the gears that interconnect the two unbalanced shafts providing increased costs and also generating expensive maintenance and generating substantial frictional heat that must be dissipated.

The Roder et al. U.S. Pat. No. 3,053,379 granted Sept. 11, 1962 is concerned with a material-handling vibrating system utilizing counter-rotating unbalanced shafts. In FIG. 6*c* of the patent, there is illustrated a drive system for a spiral conveyor having two vibrating drives. Each of the drives has a gear coupling with outboard eccentrics mounted on the shafts. Although the eccentrics are offset from each other, there is no suggestion or illustration that the eccentrics have radii greater than the radii of the matching gears that interconnect the two shafts.

One of the principal objects of the present invention is to provide a very simplified gear coupled, counter-rotating vibratory drive of the gear coupled type that dramatically reduces maintenance, increases reliability, and furthermore decreases noise. Although the previous prior art has not spcifically dealt with the noise problem, it is very significant and should be dramatically diminished.

These and other objects and advantages of this invention will become apparent upon reading the following detailed description of the preferred embodiment.

BRIEF DESCRIPTION OF THE DRAWINGS

The preferred embodiment of the invention is illustrated in the accompanying drawings, in which:

FIG. 1 is a side view of a gear coupled, counter-rotating vibratory drive assembly incorporating the applicant's invention, in which guards are shown in removed positions to illustrate the position of eccentric weights. The weights are illustrated in solid line in one position for providing a unidirectional force in a downward direction and are shown in a dotted position providing a unidirectional force in a vertical direction;

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

Figure 11:
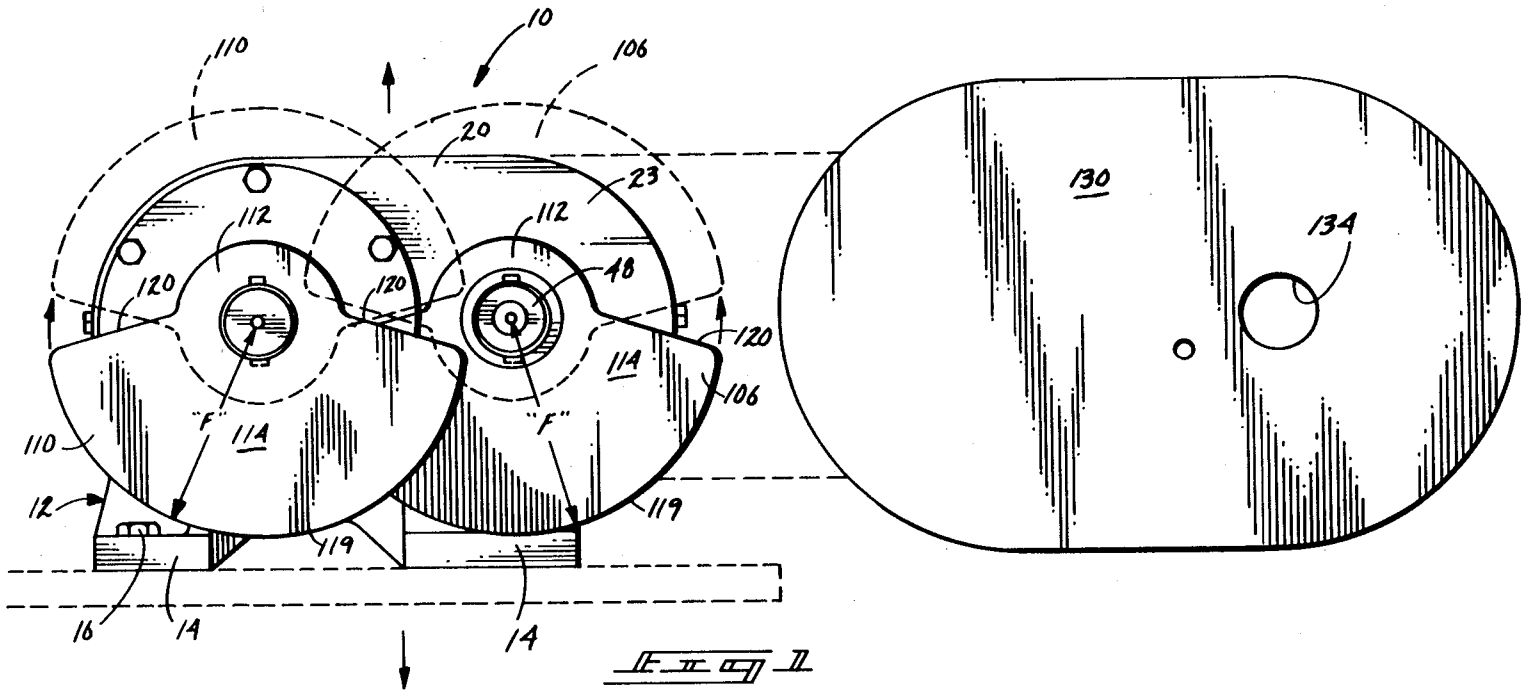
Figure 2:
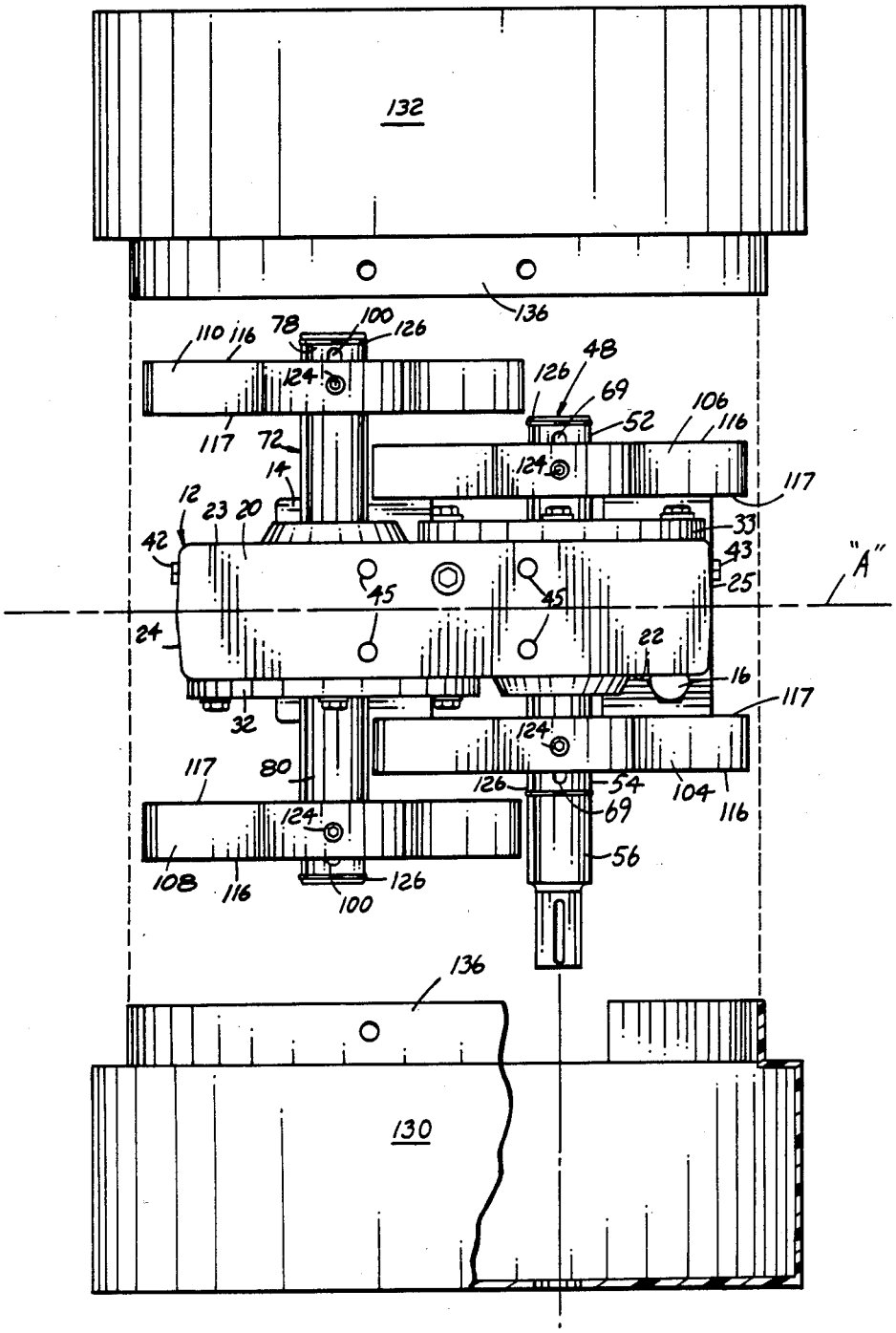
FIG. 2 is a top view of the drive assembly illustrated in FIG. 1 in which the guards are shown removed from the housing to illustrate the location of the major components including the eccentric weights.

A preferred embodiment of this invention is illustrated in FIG. 1 and is generally designated as a gear coupled, counter-rotating vibratory drive assembly 10. The assembly 10 includes a housing 12 that has a central axis "A" (FIG. 2). The housing 12 has base 14 with mounting bolts 16 for mounting the assembly 20 to a device to be vibrated such as a conveyor or particulate separator. The housing 12 includes a gear casing 10 which is preferably integral with the base. The gear casing 20 is elongated with side walls 22 and 23 that are substantially parallel with each other terminating in end walls 24 and 25. The side walls 22 and 23 are substantially equidistant from the axis "A". The gear casing 20 has a central gear box compartment 27 (FIG. 4) for housing the gearing.

Figure 4:
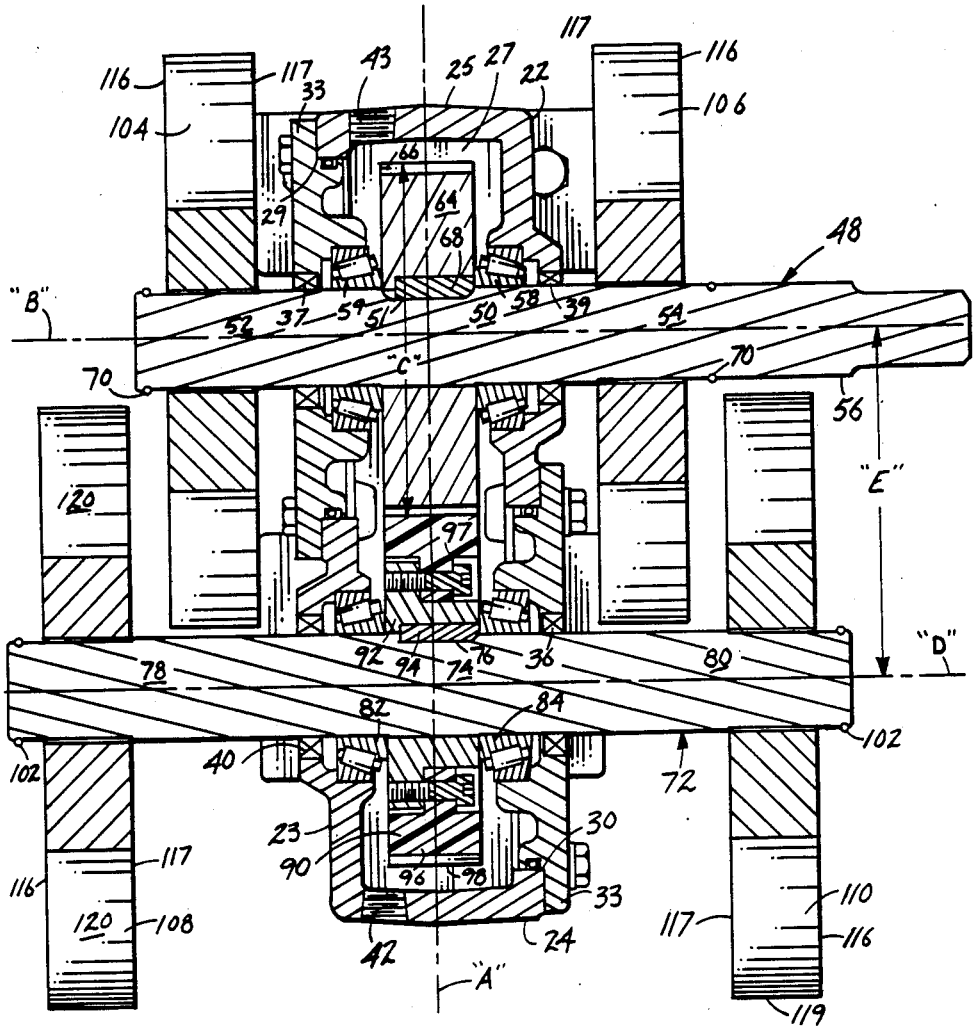
FIG. 4 is a horizontal cross-sectional view taken along line 4—4 in FIG. 3 illustrating the gear coupling between the two parallel unbalanced shafts.

The side wall 22 has a mounting opening 29 formed therein and wall 23 has a similar mounting opening 30 formed therein at offset locations with respect to each other (FIG. 4). The side walls 22 and 23 incorporate shaft mounting plates 32 and 33 that enclose the openings 29 and 30 respectively. Shaft openings 36 and 37 are formed in the shaft mounting plate 32 and the side wall 23 respectively (FIG. 4). Similarly shaft openings 39 and 40 are formed in the side wall 22 and the shaft mounting plate 33 at diametrically opposed positions (FIG. 4). Additionally, the housing has lubrication or oil openings 42 and 43 formed therein for enabling the central gear compartment 27 to receive lubricating oil. Additionally, guard mounting apertures 45 (FIG. 2) are formed in the exterior top of the housing for enabling guards to be mounted and secured to the housing.

One of the principal components of the assembly 10 is a drive shaft 48 rotatably mounted within the shaft openings 37 and 39 along axis "B". The drive shaft has a central gear section 50 that extends through the central gear compartment 27. The central section 50 has a gear keyway 51 formed therein. The drive shaft has end sections 52 and 54 that extend outward from the side walls 22 and 23 as illustrated in FIGS. 2 and 4. The drive shaft 48 further includes a drive extension 56 that forms a part of end section 54, but extends further outward for connecting to a single motor to drive the assembly. The drive shaft 48 is supported by thrust bearings 58 and 59 that are respectively mounted in the sidewalls 22 and the mounting plate 32 (FIG. 4). Additionally, drive shaft seals are mounted in the housing 12 for engaging the drive shaft 48 to prevent lubrication in the central gear compartment 27 from being displaced from the assembly. It should be noted that the drive shaft seals are outboard of the support bearings 58 and 59.

A further important component of the assembly 10 is a large drive gear 64 that is mounted on the central shaft section 50 within the central gear compartment 27 between the bearings 58 and 59. The large drive gear 64 has a prescribed diameter "C" (FIG. 4). Preferably, the drive gear 64 is formed of a metal gear having metal teeth 66. The drive gear 64 rotates in response to rotation of the drive gear 48 through a key 68 mounted in the gear keyway 51.

Each of the end sections 52 and 54 of the drive shaft 48 have keyways 69 formed in the end sections (FIG. 2). It is important to note that the keyways 51 and 69 are angularly aligned with each other to provide accurate alignment and balance. Additionally, circumferential locking grooves 70 are formed in the end sections 52 and 54 (FIG. 4).

An additional important element of the assembly 10 is a driven shaft 72 rotatably mounted to the housing 12 extending through the shaft openings 36 and 40 along axis "D". A driven shaft 72 is mounted parallel to the drive shaft 48 in which the distance between the axis "B" and the axis "D" is a distance "E". The drive shaft 72 includes a central section 74 extending through the central gear compartment 27. A keyway 76 is formed in the central section 74. The driven shaft 72 includes end sections 78 and 80, respectively, that extend outward from the side walls 22 and 23 outside the housing 12. The driven shaft 72 is supported by thrust bearings 82 and 84 respectively that are mounted in the wall 23 and the support bearing 33. The end sections 78 and 80 extend outward or outboard of the support bearings 82 and 84, respectively, in a cantilevered fashion. Shaft seals are formed in the housing engaging the driven shaft 82 to prevent leakage of lubrication oil and to prevent dust or other debris from migrating into the gear compartment 27.

A further important component of the assembly 10 is a large driven gear 90 that is mounted on the central section 74 for rotation with the driven shaft 72. The driven gear 90 has the same gear diameter as the drive gear 64 (same number of teeth). The driven gear 90 is mounted in meshing engagement with the drive gear 64 in the plane of the central axis "A" of the assembly for rotating the driven shaft 72 in synchronization and in a counter-rotating direction with the rotation of the drive shaft 48.

Preferably the driven gear 90 is formed with a metal hub portion 92 that is coupled to the driven shaft 72 through a key 94 mounted in the keyway 76 (FIG. 4). Preferably a plastic gear ring 96 is mounted circumferentially about the hub 92 engaging the metal teeth 66 with plastic teeth 98. The plastic gear ring 96 is attached to the hub 92 by bolts 97. Preferably the plastic gear ring 96 is formed of a nylon material that requires very little, if any lubrication and is quite strong. Preferably the nylon is impregnated with graphite to minimize the amount of lubrication and the friction between the plastic gear teeth 98 and the metal gear teeth 66. The applicant has found that the use of plastic teeth 98 in conjunction with the metal teeth 66 on large gears 64 and 90 dramatically reduces the amount of friction between the gear teeth and additionally reduces the noise generated by the assembly. Furthermore, after extensive tests, the applicant has found that the unit requires very little maintenance and is able to run for very long periods of time without changing the lubrication oil within the compartment 27.

Each of the shaft end sections 78 and 80 include keyways 100 (FIG. 2) formed therein and circumferential locking grooves 102 (FIG. 4). It should be noted that the keyways 76 and 100 are angularly aligned with each other to provide accurate alignment and balance. It should be noted that the driven shaft 72 is longer than the drive shaft between the end sections 52 and 54. The drive extension 56 although formed permanently on the drive shaft 48 may be considered as a connection to the drive shaft 48.

Further important components of the assembly 10 includes a pair of eccentric weights 104 and 106 that are detachably mounted on the end sections 52 and 54 for rotation with the drive shaft 48 for engendering radial forces into the assembly as the drive shaft 48 is rotated. The eccentric weights 104 and 106 are mounted on the end sections 52 and 54 equidistant from the center axis "A". Likewise a pair of eccentric weights 108 and 110 are mounted on the driven shaft 72 at the end sections 78 and 80. The eccentric weights 108 and 110 are positioned equidistant from the axis "A" and are laterally offset with respect to the eccentric weights 104 and 105 so that the eccentric weights will pass in adjacent noninterfering paths as they are rotated by the shafts. Preferably, the weights 104, 106, 108 and 110 are equally weighted so as to engender the same magnitude of radial balanced forces as they are rotated. The weights provide a balanced vibrational linear force without a twisting component. Because the two shafts 48 and 72 are driven in synchronization, the radial forces engendered by the eccentric weights counter and complement each other to provide for a resultant unidirectional vibratory force. As illustrated in FIG. 1, the eccentrics are mounted on the shafts at the same angular position so as they are rotated counter to each other, a linear up and down vibratory force is generated. The shafts may be angularly adjusted through the gearing mechanism to position the eccentric weights at angularly displaced positions to provide linear motion at a wide variety of angular directions. Thus the angular direction of the unilateral vibratory force may be adjusted as desired.

Each of the eccentric weights 104, 106, 108, and 109 have a hub section 112 (FIG. 1) for mounting onto the shaft ends. The weights have an eccentric section 114 that is shaped somewhat similar to a pie section and extend radially outward from the hub section in a flared configuration of less than 180° to a peripheral surface 119. It is preferable that the eccentric section 114 extend outward from the hub section with a sector greater than 100° but less than 180°. Each of the eccentric sections 114 has flat or parallel side surface 116 and 117 (FIG. 2). The eccentric weights have radial surfaces 120 that extend outward from the hub section to the peripheral surface 119. The distance from the axis of the hub section 112 (shaft axis) to the peripheral surface 119 is referred to as the radial peripheral distance "F" of the eccentric. The hub section 112 has a shaft bore for receiving the end sections of the respective shafts. Set screws 124 (FIG. 2) are mounted radially in the hub section 112 for extending into the keyways 69 and 100 for securing the eccentric weights onto the end sections of the shafts 48 and 72 at accurately aligned angular positions. Additionally removable snap rings 126 are mounted on the end sections being positioned within the locking grooves 70 and 102 for securing the eccentric weights onto the shafts and to prevent the eccentric weights from migrating outward off the shaft ends should the set screws 124 become loosened.

It is an important feature of this invention that the radial distance "F" of the eccentric weights is greater than the radius or one-half of the diameter "C" of the gears 64 or 90 but is less than the full diameter "C" of the gears 64 and 90. This provides for a very compact efficient arrangement in which the large gears 64 and 90 are able to operate in an enclosed environment with substantially reduced frictional engagement which greatly extends the reliability and reduces the maintenance. Furthermore, such an arrangement reduces the noise of the assembly which is particularly important where the assemblies are utilized in which human operators may be nearby.

Furthermore it should be noted that the eccentric weights 104 and 106 on the drive shaft 48 are positioned inward or inboard of the eccentric weights 108 and 110 that are mounted on the driven shaft 72. This additionally provides for a very compact arrangement enabling the system to be located in compact areas without having to minimize or compromise the stroke or vibrational force generated by the assembly 10.

Figure 3:
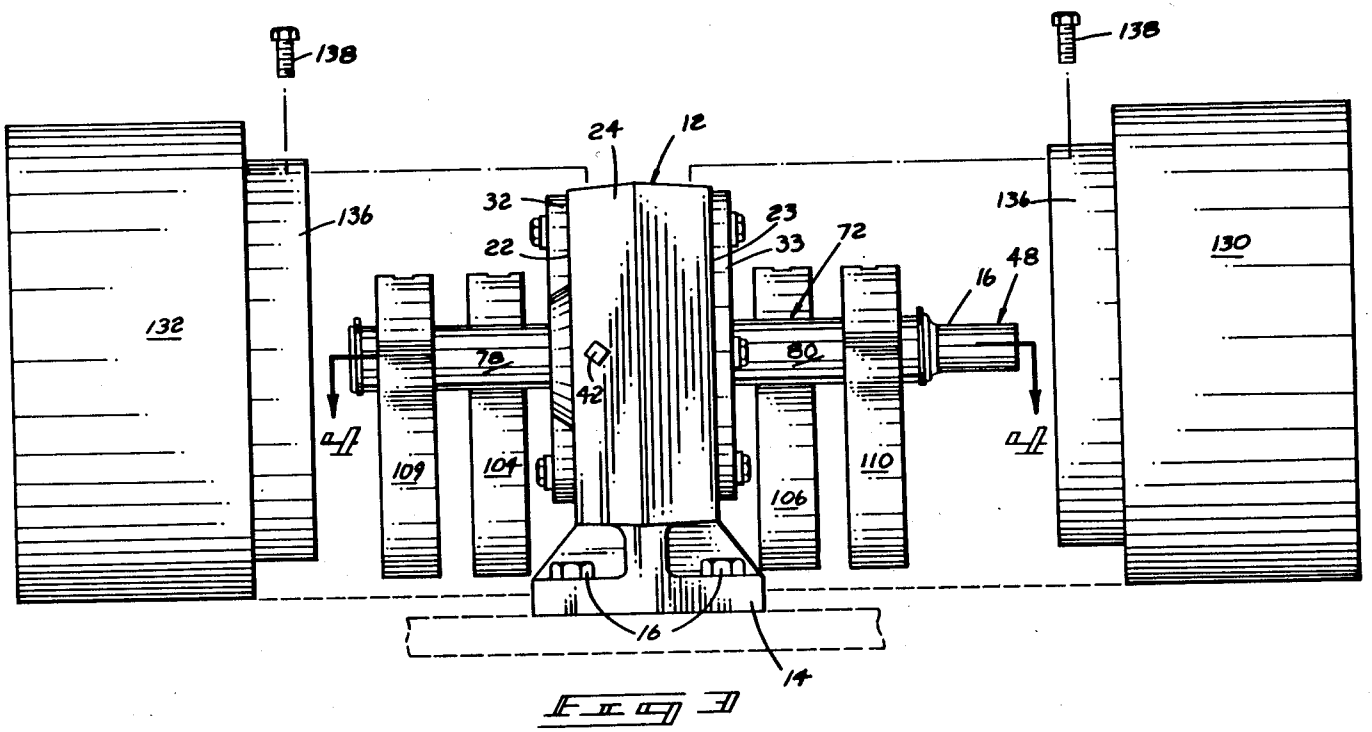
FIG. 3 is an end view of the vibratory drive illustrated in FIG. 1 with the eccentric guards removed from being attached to the assembly housing.

Further the assembly includes guards 130 and 132 that are removably mounted to the housing for fully circumscribing the eccentric weights 104, 106, 108, and 110 and their respective shaft ends. Guard 130 as illustrated in FIG. 1 has a drive shaft aperture 134 formed therein for enabling the guard to be placed over the eccentric weights 106 and 110 with the drive extension 56 extending outward through the aperture 134. It should be particularly noted that the guards fully circumscribe the eccentric weights. Additionally the periphery of the guards 130 and 132 extend outward of the end walls 24 and 25 and the top and bottom walls of the gear casing. Each of the guards 130 and 132 have a flange section 136 for attaching to the end walls and top walls of the housing 12. Bolts 138 (FIG. 3) are utilized for attaching the guard firmly to the housing to prevent injury to the operator and to minimize the entry of dirt and other debris into the path of the eccentric weights.

As previously mentioned, the applicant after a significant period of testing has found that the unit is extremely reliable and is able to operate for very long periods without any maintenance and without any undue stress. Also the invention provides a balanced vibrational force without a twisting component. Applicant is unable to at this point determine exactly how much longer and how much more reliable the assembly is than those presently available on the market but is appears that the unit is many fold more reliable and less costly to maintain.

Furthermore, the applicant, previous to the present invention, was required to keep in stock approximately 15 separate different size vibratory units to properly serve the industry. However, with the present invention, the applicant only needs to keep in stock two different size housings—a small housing and a large housing—and 15 different size eccentric weights. This dramatically reduces the cost of inventory. Furthermore, it dramatically decreases the cost of manufacturing the units.

For the customer, it dramatically decreases the cost through increased reliability and decreased maintenance. Additionally, the operator is able to rapidly remove the eccentric weights and put on other weights should the conditions or the products being conveyed or separated change, without having to remove the assembly and put on a new assembly. Consequently, the invention provides a dramatically more versatile unit than is presently available.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A gear coupled, counter-rotating vibratory drive assembly comprising:

a housing for operatively connecting to a device to be vibrated in a desired linear motion;

said housing having a prescribed length with an elongated central gear box compartment formed therein;

a drive shaft extending through the gear box compartment and rotatably supported by drive shaft support bearings for rotation about a drive shaft axis;

said drive shaft having a central gear section intermediate the drive shaft support bearings and end section extending outward from the central gear section and the drive shaft support bearings exterior of the gear box compartment;

a drive gear having a prescribed diameter mounted on the central gear section for rotation with the drive shaft within the gear box compartment;

a driven shaft extending through the gear box compartment and rotatably supported by driven shaft support bearing for rotation about a driven shaft axis that is parallel with the drive shaft axis;

said driven shaft having a central gear section intermediate the driven shaft support bearings and end sections extending outward from the central gear section and the driven shaft support bearings, exterior of the gear box compartment;

a driven gear mounted on the central gear section intermeshed with the drive gear for rotating the driven shaft at the same angular speed but in a direction counter to the drive shaft;

eccentric weights mounted on the end sections of both the drive shaft and the driven shaft for rotation therewith in counter-rotating directions about the shaft axes in phased angular relationship to generate vibrational linear motion;

each of the eccentric weights having a prescribed peripheral radius from the respective shaft axis that is less than the prescribed diameter of the drive gear but greater than one-half the prescribed diameter of the drive gear wherein the eccentric weights on the drive shaft are mounted axially offset with respect to the eccentric weights on the driven shaft so that the eccentric weights rotate in noninterfering paths; and wherein one of gears has metal teeth and wherein the other gear has a metal hub with a plastic gear ring mounted on the hub in which the plastic gear ring has plastic teeth engaging the metal teeth of the one gear.

2. The counter-rotating vibratory drive assembly as defined in claim 1 wherein the housing has a central housing axis normal to the shaft axes and wherein the eccentric weights on each shaft are equally spaced from the central housing axis.

3. The counter-rotating vibratory drive assembly as defined in claim 1 wherein the eccentric weights on the driven shaft are mounted axially offset outward of the eccentric weights on the drive shaft.

4. The counter-rotating vibratory drive assembly as defined in claim 1 wherein each of the eccentric weights may be removed and replaced from an end section without removing or replacing a shaft support bearing.

5. The counter-rotating vibratory drive assembly as defined in claim 1 wherein the eccentric weights are identically shaped and have the same weight.

6. The counter-rotating vibratory drive assembly as defined in claim 5 wherein each of the eccentric weights has a hub section and an eccentric section extending from the hub section to a periphery and wherein each of the radius sections has a constant thickness from the hub section to the periphery.

7. The counter-rotating vibratory drive assembly as defined in claim 1 wherein the plastic gear teeth are formed of a nylon plastic material.

8. The counter-rotating vibratory drive assembly as defined in claim 1 wherein each of the end sections of the shafts have a terminal cylindrical groove formed therein with removable snap rings mounted therein for securing the eccentric weights on the end sections.

9. The counter-rotating vibratory drive as defined in claim 1 further comprising guards detachably mounted to the housing in which each of the guards has a major dimension greater than the length of the housing with the guards extending beyond the housing to fully encircle the eccentric weights.

* * * * *